United States Patent [19]

Stout

[11] Patent Number: 4,598,776

[45] Date of Patent: Jul. 8, 1986

[54] METHOD AND APPARATUS FOR FIRING MULTISECTION PERFORATING GUNS

[75] Inventor: Gregg W. Stout, Montgomery, Tex.

[73] Assignee: Baker Oil Tools, Inc., Orange, Calif.

[21] Appl. No.: 743,579

[22] Filed: Jun. 11, 1985

[51] Int. Cl.[4] ..... E21B 43/116

[52] U.S. Cl. ..... 175/4.54; 175/4.56

[58] Field of Search ..... 175/4.54–4.56; 166/297–299, 55.2; 102/318, 320

[56] References Cited

U.S. PATENT DOCUMENTS

| | | | |
|---|---|---|---|
| 2,925,775 | 2/1960 | McKee | 175/4.56 |
| 3,648,785 | 3/1972 | Walker | 175/4.54 |
| 4,011,815 | 3/1977 | Garcia | 175/4.56 X |
| 4,491,185 | 1/1985 | McClure | 175/4.56 |

*Primary Examiner*—James A. Leppink
*Assistant Examiner*—Thuy M. Bui
*Attorney, Agent, or Firm*—Norvell & Associates

[57] ABSTRACT

A more reliable operation of a multisection perforating gun for a subterranean well is achieved by disposing a detonation-transmitting element in parallel relationship to the conventional arrangement of booster charges and primer cords by which the detonating energy is transmitted from one gun section to the next. In one embodiment the detonation-transmitting element extends adjacent the primer cord from the upper portion of a gun section to a medial portion of the primer cord in the gun section, where the bottom end of the detonation-transmitting element is secured to an auxiliary booster charge having sufficient detonating energy to effect the detonation of the medial portion of the primer cord. In another modification, the detonation-transmitting element is radially spaced from the primer cord and has a circular, radially disposed portion at its upper end which is ignited by the booster charge secured to the bottom end of the flame-transmitting element in the upwardly adjacent section.

14 Claims, 3 Drawing Figures

METHOD AND APPARATUS FOR FIRING MULTISECTION PERFORATING GUNS

CROSS-REFERENCE TO RELATED APPLICATION

This application is related in subject matter to: U.S. patent application Ser. No. 743,580, entitled "Method and Apparatus for Initiating Subterranean Well Perforating Gun Firing from Bottom to Top"; U.S. patent application Ser. No. 743,429, entitled "Perforating Gun for Initiation of Shooting from Bottom to Top"; and U.S. patent application Ser. No. 743,578, entitled "Boosterless Perforating Gun and Method of Assembly".

BACKGROUND OF THE INVENTION

1. Field of the Invention

The invention relates to a method and apparatus for effecting the reliable firing of a perforating gun for a subterranean well, and particularly a multisection gun with each section having a plurality of shaped charges mounted for substantially concurrent firing to produce perforating zones on the order of 50 to 2,000 feet in length.

2. History of the Prior Art

The utilization of a plurality of vertically and angularly spaced shaped charges to effect the perforation of a subterranean well represents the modern approach to achieving perforation of the well casing and the adjoining production formation. Such shaped charges are generally substantially concurrently fired by the ignition of a primer cord which is positioned adjacent the ignition ends of each of the shaped charge containers in the gun section. It is now not uncommon for the zone to be perforated to extend from 50 to 1,000 feet in length, thus necessitating the fabrication of the perforating gun as a plurality of axially stacked, substantially identical gun sections. The transmission of the firing energy from the uppermost section to the lowermost section is commonly accomplished by the mounting of booster charges on each of the ends of a length of primer cord which is utilized only within an individual gun section. The booster charges are required to insure that sufficient detonation energy is transmitted from the bottom end of one primer cord to the top end of the next primer cord to insure the successive detonation of all primer cords. There have been many instances of unsuccessful transfer of detonation energy from one gun section to the next, necessitating the very costly and time-consuming procedure of removing the apparatus from the well in order to reconnect the uppermost primer cord where detonation failed, to a suitable booster charge and, in turn, position a new firing mechanism in proximity to the booster charge.

The exact cause of failures to transfer detonation energy from one gun section to the next is not readily pinpointed. Of course, a defective length of primer cord or a defective booster would interrupt the detonation of the particular primer cord. Booster charges are conventionally secured to the ends of the primer cord by a crimping operation, and this operation may very well damage the explosive core of the primer cord. The primer cord may have picked up water or may have become desensitized by grease. Any of these adverse elements can cause the detonation velocity of the primer cord to drop off to a low order, insufficient to effect the firing of the shaped charge containers and, in fact, causing the interruption of the detonation wave down the primer cord. Thus, in a 2,000-foot multisection perforating gun, it is not uncommon for several hundred feet of gun to be successively fired, only to have the detonation wave interrupted for one or more of the above stated reasons and thus leaving a very large number of shaped charges which have not been fired. The only cure is to expend the necessary rig time to pull out all of the gun sections and then reinsert in the well a length of gun equivalent to the extent of the production zone which was not perforated by the initial firing of the perforating gun.

Obviously, any procedure or apparatus which would provide greater assurance that all of the successive lengths of primer cord will be detonated, thus hopefully insuring the detonation of most, if not all, of the shaped charges, can be of tremendous value to the oil well completion industry.

SUMMARY OF THE INVENTION

The invention is particularly applicable to multisection perforating guns to be utilized in a subterranean well when a substantial length of production zone is to be perforated in a single operation.

A multisection perforating gun of conventional configuration is assembled in conventional fashion through the axial stacking of a plurality of substantially identical perforating gun sections. Each gun section comprises a plurality of vertically and angularly spaced, shaped charge containers supported by suitable carrier. An individual length of primer cord is provided for each gun section, which cord passes closely adjacent to the ignition end of the shaped charge containers disposed in the particular gun section. A conventional booster charge is secured to both the top and bottom ends of the length of primer cord in the gun section and these booster charges are utilized to insure the transmission of detonating energy from the uppermost gun sections to each of the successively lower gun sections or vice versa.

In accordance with this invention, a backup or duplicate system for transmission of detonating energy from one gun section to the next lower gun section is provided. A length of flame-conveying element or fusible cord, preferably a flexible tubing element comprising a plastic tube having an explosive powder adhered to its interior bore, is inserted in each gun section in parallel relationship to the primer cord. In accordance with one embodiment, the upper end of the flame-transmitting tubing is adjacent the upper end of the primer cord and its upper end is ignitable by the lower booster charge in the upwardly adjacent gun section. The lower end of the flame-transmitting tubing is secured to any convenient medial portion of the length of primer cord disposed in the respective gun section. Intermediate the flame-transmitting tubing and the primer cord, a secondary booster charge is connected. The energy of this booster charge is sufficient to convert the relatively low-deflagration rate of flame-transmission produced by the flame-transmitting tubing to a detonating wave of sufficient intensity to detonate the adjacent medial portion of the primer cord. Such booster charges are commonly referred to as DDT charges, such as those sold under the trademark "PRIMADETS" by the Ensign Bickford Co. of Simsbury, Conn.

In accordance with another embodiment of the invention, a length of detonation-transmitting tubing is inserted in each perforating gun section at the factory and passes through an axially parallel aperture in the coupling nipple secured to the upper end of the perforating gun section. The upper end of the detonation-transmitting tubing is disposed in a circular configuration and lies against the upper end face of the connecting nipple. The lower end of the detonation-transmitting tubing passes through a similar radially displaced axial passage provided in the connecting sub and terminates in a charge, such as a DDT charge, immediately above the top end of the next gun section.

When the nipple on the top end of one perforating gun section is secured to the connecting sub on the lower end of another perforating gun section, then the DDT charge is disposed immediately above a portion of the circle formed by the top end of the detonation-transmitting tubing and effects the firing of such tubing to transmit the firing energy of the next section. The primer cord is conventionally mounted in an axial passage and terminates at the top end of the gun section in a booster charge, and at the lower end of the gun section in another booster charge connected to the end of the primer cord. Thus, the detonation of the booster charges of the primer cord will effect the transmission of energy across each of the connections of the gun sections and the firing of the multiplicity of gun sections, or alternatively, the detonation of the DDT charge will effect the detonation of the adjacent booster charge.

In addition to a detonation-transmitting element, there are also other devices sensitive to shock or percussion from preceding guns which could convert a low-order detonating condition back a high order.

Since the deflagration rate of the detonation-transmitting tubing is substantially lower than the detonation rate of any conventional primer cord, if the transfer of detonating energy from the lowermost booster charge of an upper section to the uppermost booster charge of the next lower section is accomplished in conventional fashion, the primer cord will have been detonated throughout the entire lower section before the detonation transmitted by the tubing reaches the auxiliary booster charge. Thus, nothing happens, because proper detonation of the primer cord in the particular gun section has been achieved. On the other hand, if the transfer of detonating energy from the lowermost gun section is interrupted for any cause, the detonation transmitted by the flame-transmitting tubing will effect the detonation of the auxiliary booster charge and it in turn will effect the detonation of the medial portion of the primer length in the respective gun section in one modification and detonation of the primer cord booster charge in the other modification. Such primer cord can detonate both upwardly and downwardly from the point of attachment of the auxiliary booster charge and thereby effect the detonation of all of the shaped charges contained within the particular gun section, as well as the bottom booster charge secured to the bottom end of the particular primer cord for transmission of detonating energy to the next lower gun section.

It is thereby assured that the transmission of detonating energy from each successive gun section to the next lower section will occur, even though the detonation of the primer cord conventionally accomplished by the auxiliary spaced, adjacent booster charges may, for some unknown reason, fail. Other advantages of the invention will be readily apparent to those skilled in the art from the following detailed description, taken in conjunction with the annexed sheets of drawings, on which is shown two embodiments of the invention.

DESCRIPTION OF THE PREFERRED EMBODIMENTS

Figure 1:
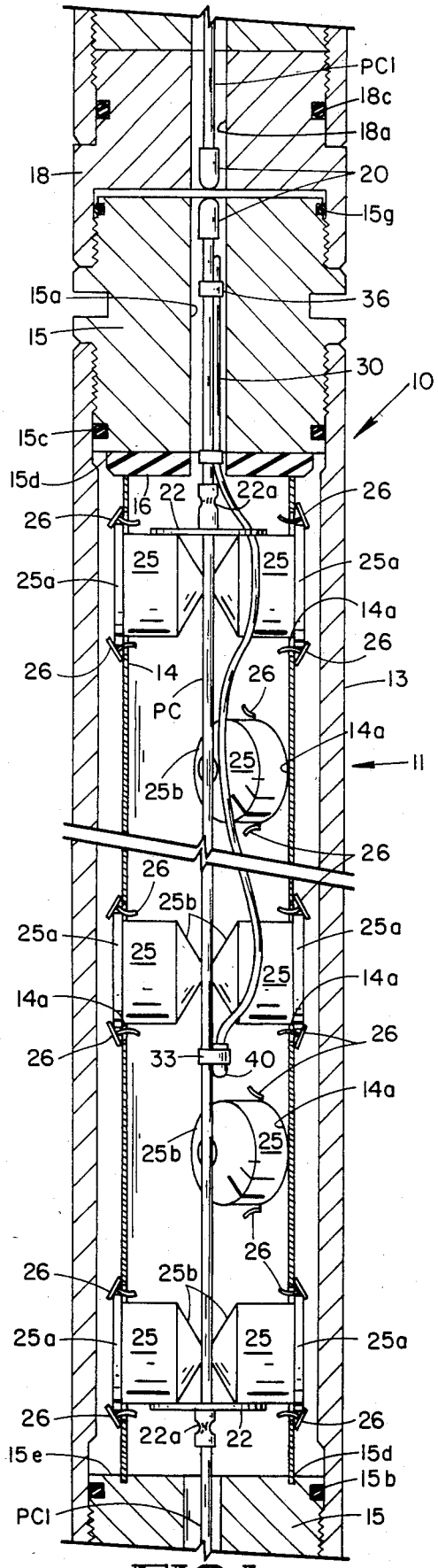
FIG. 1 represents a vertical sectional view through a portion of a multisection perforating gun embodying this invention.

Referring to FIG. 1, there is shown a portion of an assembled, multisection perforating gun 10. As is conventional, the perforating gun 10 terminates at its upper end in a firing head (not shown) which is threadably connected to the lower end of a suitable well conduit. The gun 10 may be hooked in series to extend for a length of from 50 to 2,000 feet, depending upon the length of the zone to be perforated. It necessarily follows that the perforating gun 10 must comprise an assembly of a plurality of gun sections 11. Each gun section is substantially identical, comprising a cylindrical housing 13 which is internally threaded at both its upper and lower ends for interconnection by externally threaded hollow nipples 15 and connection subs 18. Such threaded connections are sealed by O-rings **15*c*, 15*g*, and 18*c***.

A plurality of vertically and angularly spaced shaped charge containers 25 are mounted within each housing section 13. The specific manner of mounting such charges forms no part of this invention and they may either be sealably mounted in the walls of housing sections 13 may be mounted in vertically spaced apertures **14*a* provided in the walls of the polygonal cross-section, tubular carrier 14 which is concentrically positioned within the interior of each tubular housing section 13. An elastomeric protective washer 16 may be provided between the ends of the polygonal carrier 14 and the adjacent end faces 15*d* and 15*e* of the nipples 15**.

Each shaped charge container is provided with an enlarged flange **25*a* and this flange is held in the respective aperture 14*a* in the carrier 14 by blind rivets 26** in the manner described in detail in co-pending application Ser. No. 432,481 filed Oct. 4, 1982, and assigned to the Assignee of this Application.

The inner or detonating ends **25*b* of each shaped charge container 25 are of conventional frusto-conical configuration and are disposed in substantially concentric relationship to the tubular housing 13. Within each housing a length of primer cord PC is inserted between all of the inner ends of the shaped charge containers 25 and is crimped at each end into a stamped supporting member 22 having a circular flange 22*a*. Flange 22*a* rests upon the uppermost set of shaped charge containers 25 at the upper end of each gun section and at the lower end a similar flange 22*a* abuts the lowermost set of shaped charge containers 25. A booster charge 20 is additionally crimped around each end of the primer cord PC, so that when the gun sections are connected, a pair of booster charges 20 are disposed in axial proximity in the connecting nipple 15 to transmit the detonating energy from the upper booster charge 20 to the lower booster charge 20 located at the upper most end of the next lower gun section. Thus, the detonating energy is transmitted from one gun section to the next by the detonation of booster charges 20 and the detonating energy is substantially increased at the top and bottom of each individual gun section through the provision of the booster charges 20**.

All of the aforedescribed apparatus constitutes conventional elements of a multisectional perforating gun, but as stated above, such guns have been plagued with an interruption of the transmission of the detonating energy from one gun section to another, particularly when many of such sections are assembled into a single gun.

To overcome this deficiency, this invention provides a backup detonating energy transmission system in the form of a flexible or detonation-transmitting tube 30 which comprises a thinwalled thermoplastic tube having the interior thereof coated with an explosive powder. Hence the flexible tube 30 may be fusible cord could also be used. The detonation-transmitting tube 30 preferably comprises a shock tube sold under the trademark "NONEL" by the Ensign Bickford Company of Simsbury, Conn. The NONEL shock tube is a hollow plastic tube of about 3/16-inch diameter with a very small amount of reactive material coating the inside wall which, when ignited, propogates a flame shock wave signal at a rate on the order of 6,000 feet per second. The NONEL shock tube 30 is thus incapable effecting the detonation of the primer cord PC, even though it is disposed in contiguous relationship thereto. It does have sufficient energy, however, to effect the ignition of certain booster charges.

A length of NONEL shock tube 30 traverses a portion of each gun section, extending from a connection by a clip 36 to the upper end of the primer cord PC in each gun section, thence downwardly through the gun section to a connection with a medial portion of the primer cord PC in the gun section through the medium of a secondary booster charge 40 which is secured to the primer cord PC by a clip 33. The secondary booster charge 40 is of the type commonly known in the art as a DDT charge, which is capable of being detonated by the detonation transmitted by the NONEL shock tube 30, and, when detonated, will generate sufficient energy to effect the detonation of the adjacent primer cord PC. Such DDT charges are sold by the aforementioned Ensign Bickford Company under the trademark "PRIMADETS".

The NONEL shock tube is ignited by detonation of the booster charges 20 and the detonation is carried downwardly to detonate DDT charge 40. The primer cord PC detonates and such detonation spreads both upwardly and downwardly from the point of detonation by the auxiliary booster charge 40. Thus, all of the shaped charge containers 25 in the particular gun section, both above and below the point of connection of the detonation-transmitting tube 35 to the primer cord PC are detonated, and the detonating primer cord PC further causes the detonation of the conventional booster charge 20 provided at the lower end of the particular gun section.

It is thereby assured that the detonating energy will traverse each of the gun section connections defined by the nipples 15 and connecting subs 18. More importantly, in the event that the conventional primer cord PC and the booster charges 20 operate in normal fashion, then no adverse effects are produced by the concurrent ignition of the detonation-transmitting tube 30 for the reason that the detonation speed of the primer cord PC is at least double that of the flame propogation or deflagration rate of the NONEL shock tube 30. Thus, before the detonation in the NONEL shock tube 30 reaches the medial portion of the primer cord PC in the next lower gun section, such primer cord PC will already have been detonated and all of the shaped charges disposed in the particular gun section will likewise have been detonated. Such detonation most likely will result in a fragmentation and burning of the NONEL shock tube 35, so that its existence has no adverse effect on the operation of the perforating gun section which is properly fired by the primer cord PC.

Figure 2:
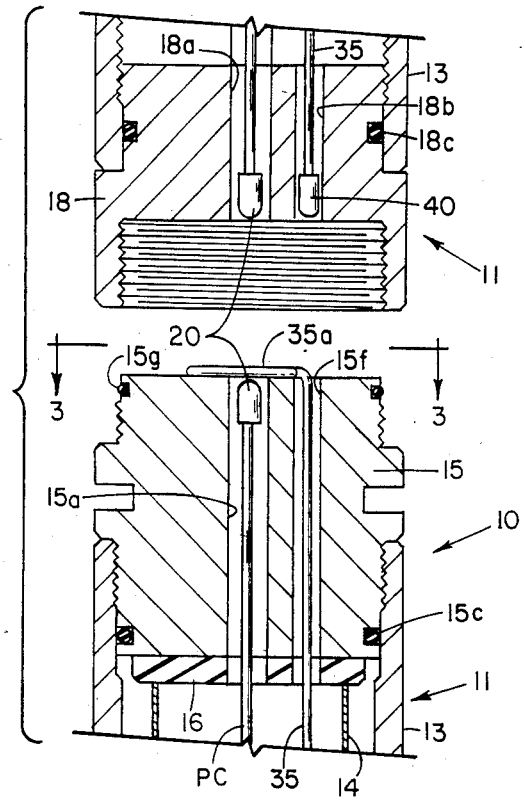
FIG. 2 is a view similar to FIG. 1, but illustrating a modification of this invention.

In the modification of FIG. 2, there is shown the bottom end of one gun section 11 disposed in the preassembled spaced relationship to the top end of the next gun section 11. The connecting subs 18 are provided with an axial passage **18*b* which is radially spaced with respect to the central bore 18*a* of each connecting sub. 18. Similarly, the nipples 15 are provided with an axial passage 15*f* radially spaced from the central bore 15*a* of each nipple 15 by the same distance as the radial spacing of the passage 18*b***.

Figure 3:
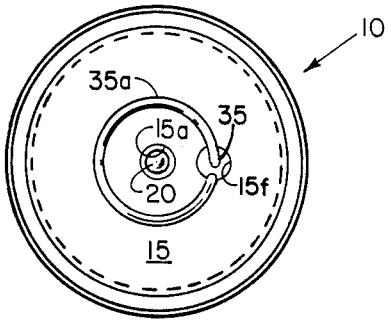
FIG. 3 is a sectional view taken on the plain 3—3 of FIG. 2.

Passages **18*b* and 15*f* are utilized for mounting the length of NONEL shock tube 35 in parallel relationship to the primer cord PC. Because the radial passages 18*b* and 15*f* will not be exactly aligned in each threaded connection of the connecting sub 18 to the nipple 15, the top end of the NONEL shock tube 35 is formed in a circular configuration 35*a* lying in a radial plane, as best shown in FIG. 3. The length of NONEL shock tube 35 extends entirely through each perforating gun section 11 and terminates at its lower end in a crimped connection to a DDT transfer booster charge 40. Thus, when the perforating gun 10 is fired, and the axially adjacent booster charges 20 connected to the primer cords PC are detonated, such detonation will effect the concurrent ignition of the top circular end of the detonation-transmitting tubing 35. If for any reason, the detonation of the primer cord PC does not carry down to the next set of booster charges 20, the detonation transmitted by the shock tube will effect the detonation of the DDT charge 40 which, in turn will effect the detonation of the booster charges 20 mounted on the adjacent bottom and top ends of primer cords PC of the two adjacent gun sections. If these booster charges do not detonate, the detonation of the DDT charge 40 will effect the ignition of the circular top end 35*a* of the detonation-transmitting tubing 35 of the next lower perforating gun and carry the detonation downwardly through the next lower gun section to effect the detonation of the booster charge 20 disposed at the lower end of the gun section. Thus, there are really two opportunities provided for effecting the detonation of a primer cord contained within a particular gun section by the NONEL shock tube. Either the booster charge 20 at the top end of the particular primer cord PC will be detonated by the DDT charge 40 of the upwardly adjacent gun section, or the booster charge 20 at the lower end of the primer cord PC for the particular section will be detonated by the detonation transmitted down the NONEL shock tube 35 to the booster charge 40** at the bottom end of the particular gun section.

As will be recognized by those skilled in the art, the cost of the backup detonating systems heretofore described is negligible compared to the cost of retrieving and replacing a defective gun in the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of producing the detonation of shaped charges disposed in a plurality of vertically stacked, perforating gun sections for a subterranean well, comprising the steps of:

(1) running a primer cord through each gun section adjacent the ignition end of each shaped charge container in the section;

(2) securing a booster charge to the top and bottom ends of each primer cord to transmit a detonating force from the bottom of one gun section to the top of the next gun section;

(3) positioning a low-deflagration rate detonation-transmitting element in each gun section in parallel relationship to at least a portion of said primer cord with the upper end thereof disposed in proximity to said booster charge of an upwardly adjacent gun section; and (4) connecting the lower end of said detonation-transmitting element to a charge disposed adjacent said primer cord of the lower adjacent gun section, thereby assuring transfer of detonating energy from each gun section to the next adjacent gun section.

2. The method of claim 1 wherein the deflagration rate of said detonation-transmitting element is substantially less than the detonation rate of said primer cord.

3. The method of providing the detonation of shaped charges disposed in a plurality of vertically stacked perforating gun sections for a subterannean well, comprises the steps of:

(1) running a primer cord through each gun section adjacent the ignition end of each shaped charge container in the section;

(2) securing a booster charge to the top and bottom ends of each primer cord to transmit a detonating force from the bottom of one gun section to the top of the next gun section;

(3) positioning a low-deflagration rate detonation-transmitting element in each gun section in parallel relationship to at least a portion of said primer cord with the upper end of said detonation-transmitting element disposed in proximity to the lower booster charge of the upwardly adjacent gun section; and (4) connecting the lower end of said detonation-transmitting element to a charge disposed adjacent the booster charge at the bottom of the section containing the respective detonation-transmitting element.

4. The method of providing the detonation of shaped charges in a plurality of vertically stacked perforating gun sections for a subterranean well, comprising the steps of:

(1) running a primer cord through each gun section adjacent the ignition end of each shaped charge container in the section;

(2) securing a booster charge to the top and bottom ends of each primer cord to transmit a detonating force from the bottom of one gun section to the top of the next gun section;

(3) positioning a low-deflagration rate transmitting element adjacent to the bottom booster charge in one gun section and extending said element downwardly into the medial portion of the next lower gun section; and (4) securing a charge between the bottom end of said transmitting element and the medial portion of the primer cord in said next lower gun section thereby providing a backup detonation of the primer cord in the said next lower gun section.

5. The method of providing the detonation of shaped charges in a plurality of vertically stacked perforating gun sections for a subterranean well, comprising the steps of:

(1) running a primer cord through each gun section adjacent the ignition end of each shaped charge container in the section;

(2) securing a booster charge to the top and bottom ends of each primer cord to transmit a detonating force from the bottom of one gun section to the top of the next gun section;

(3) positioning a low-deflagration rate detonation-transmitting element adjacent to the bottom booster charge in one gun section and extending said element downwardly into the next lower gun section in generally parallel relationship to the said primer cord in such lower section;

(4) securing a charge to the bottom end of said detonation transmitting element; and (5) positioning said charge in adjacent relationship to one of said primer cord and said bottom booster charge of said next lower gun section.

6. The method of claim 5 wherein the deflagration rate of said detonation-transmitting element is substantially less than the detonation rate of said primer cord.

7. In a multisection perforating gun for perforating an extended length of a subterranean well, each gun section having a plurality of vertically spaced, shaped charge containers; a length of primer cord traversing the length of each gun section and lying adjacent the ignition end of each shaped charge container in the respective gun section, and a booster charge on each of the top and bottom ends of the primer cord positioned to transmit a detonating force from the bottom end of a primer cord length to the top end of the primer cord length in the next lower gun section, the improvement comprising; detonation-transmitting element disposed in each gun section in parallel relationship to said primer cord and with the upper end thereof disposed in proximity to the bottom booster charge of the upwardly adjacent gun section; and means operable by flame transmitted by said detonation-transmitting element to detonate a lower portion of the primer cord of the respective gun section.

8. The perforating gun of claim 7 wherein said last-mentioned means comprised a charge disposed adjacent one of said primer cord and said lower booster charge of the respective section.

9. The perforating gun of claim 7 wherein the upper end of said detonation-transmitting element comprises substantially a circle lying in a radial plane adjacent the upper end of the respective gun section.

10. In a multisection perforating gun for perforating an extended length of a subterranean well, each gun section having a plurality of vertically spaced, shaped charge containers; a length of primer cord traversing the length of each gun section and lying adjacent the ignition end of each shaped charge container in the respective gun section, and a booster charge on each of the top and bottom ends of the primer cord positioned to transmit a detonating force from the bottom end of a primer cord length to the top end of the primer cord length in the next lower gun section; the improvement comprising: a detonation-transmitting element mounted in each gun section in parallel relationship to said primer cord and with the upper end thereof disposed in proximity to the bottom booster charge of the upwardly adjacent gun section; a charge secured to the bottom end of said detonation-transmitting element and positioned at the lower end of said gun section in adjacent relationship to both said bottom booster charge of the respective gun section and the upper booster charge of the next lower gun section.

11. The perforating gun of claim 10 wherein the upper end of said detonation-transmitting element comprises substantially a circle lying in a radial plane adjacent the upper end of the respective gun section.

12. In a multisection perforating gun for perforating an extended length of a subterranean well, each gun section having a plurality of vertically spaced, shaped charge containers; a length of primer cord traversing the length of each gun section and lying adjacent the ignition end of each shaped charge container in the respective gun section; and a booster charge on each of the top and bottom ends of the primer cord positioned to transmit a detonating force from the bottom end of a primer cord length to the top end of the primer cord length in the next lower gun section, the improvement comprising: a detonation transmitting element having its top end positioned adjacent said bottom booster charge in an upper gun section and extending to a medial portion of the said primer cord in the next lower gun section; and a booster charge interconnecting said bottom end of said detonation transmitting element and said medial portion of said primer cord in the next lower gun section.

13. The multisection perforating gun of claim 12 wherein the deflagration rate of said detonation-transmitting element is substantially less than the detonation rate of said primer cord length.

14. The multisection perforating gun of claim 12 wherein the deflagration rate of said detonation-transmitting element is substantially less than the detonation rate of said primer cord length, and said booster charge is detonatable by the tubing-transmitted detonation to in turn detonate any adjacent portions of said primer cord that have failed to detonate.

* * * * *